United States Patent [19]

Vayko

[11] Patent Number: 4,683,980

[45] Date of Patent: Aug. 4, 1987

[54] LADDER-LEVELING DEVICE

[76] Inventor: Don Vayko, 4185 Hill Dr., Utica, Mich. 48087

[21] Appl. No.: 851,250

[22] Filed: Apr. 14, 1986

[51] Int. Cl.[4] ..... E06C 7/46

[52] U.S. Cl. ..... 182/108; 182/46; 182/201

[58] Field of Search ..... 182/107, 108, 109, 110, 182/111, 204, 205, 200, 46, 201

[56] References Cited

U.S. PATENT DOCUMENTS

| | | | |
|---|---|---|---|
| 755,713 | 3/1904 | Shanahan | 182/110 |
| 1,431,068 | 10/1922 | Waney | 182/109 |
| 1,600,103 | 9/1926 | Evans | 182/108 |
| 1,631,513 | 6/1927 | Berry | 182/201 |
| 2,138,171 | 11/1938 | Johnson | 182/111 |

FOREIGN PATENT DOCUMENTS

| | | | |
|---|---|---|---|
| 6177 | of 1890 | United Kingdom | 182/108 |
| 259087 | 10/1926 | United Kingdom | 182/108 |
| 449973 | 7/1936 | United Kingdom | 182/108 |

*Primary Examiner*—Reinaldo P. Machado

*Attorney, Agent, or Firm*—Krass & Young

[57] ABSTRACT

A load leveling device for a ladder in the form of a compensator boot which slips onto a lower end of one of the legs of the ladder. The boot includes a vertically elongated block of homogeneous, molded plastic or rubber material and a vertically extending socket in the block opening in the upper end face of the block. The socket has cross-sectional dimensions sized to allow the lower end of the leg of the ladder to slide into the socket and has a blind lower end spaced vertically from the lower end face of the block by a distance compensating for the angle of the associated roof surface. The lower end face of the block is centrally downwardly pointed to form a central apex edge, and the end face portions on the opposite sides of the central apex edge are each skewed, but in opposite senses, to match the roof angle so that the block will present a flat contact surface complementary to the roof angle irrespective of the sense in which the boot is applied to the ladder leg, irrespective of which ladder leg it is applied to, and irrespective of which side of the roof ridge the ladder is positioned on.

8 Claims, 4 Drawing Figures

LADDER-LEVELING DEVICE

BACKGROUND OF THE INVENTION

This invention relates to ladder leveling devices and more particularly to extension or stabilizer devices which facilitate the use of ladders on uneven or angled surfaces.

The problem of ladder utilization on uneven surfaces has long been recognized and a variety of proposals have been made in an attempt to provide convenient and efficient ladder leveling devices to permit safe use of ladders on uneven or sloping surfaces. All of the known prior art devices, however, have shortcomings and disadvantages. Several of the known devices include components which are permanently or semi-permanently attached to the ladder and other extension components which engage with the attached components to permit leveling of the ladder. However, these constructions create relatively high, localized stress concentrations, particularly at the interconnection of the attached and extension components, with the result that the ladder so equipped may ultimately fail. Further, the use of permanently or semi-permanently attached components is undesirable because they add unnecessarily to the weight of the ladder, and also because they interfere with the natural balance of the ladder, making handling and transporting of the ladder awkward. Certain other of the known devices includes bolts or other locking means which extend into the inner area of the ladder where they interfere with proper use of the ladder and present a safety hazard. Other prior art leveling devices have been unduly complicated and/or have required customizing of the legs of the ladder to accommodate the leveling devices.

SUMMARY OF THE INVENTION

The present invention is directed to the provision of a ladder leveling device which is simple and inexpensive in construction and operation and which functions to provide efficient ladder leveling in commonly encountered sloping surface applications.

The ladder leveling device according to the invention comprises a compensator boot comprising a vertically elongated block of material and a vertically extending socket in the block opening in the upper end face of the block. The socket has cross-sectional dimensions sized to allow the lower end of a leg of a ladder to slide into the socket and has a blind lower end spaced vertically from the lower end face of the block by a distance compensating for the roof angle, and means are provided to define a flat contact surface on the lower end face of the block that is skewed with respect to the vertical axis of the block to match the roof angle. This simple and inexpensive boot construction allows the invention compensator boot to be readily slipped on or off either leg of the ladder and is especially suitable for use on angled roofs where the dimensions of the boot may be carefully tailored to specifically and precisely compensate for known roof angles.

According to a further feature of the invention, the lower end face of the block is centrally downwardly pointed to form a central apex edge and the end face portions on opposite sides of the central apex edge are skewed in opposite senses to match the roof angle. With this arrangement, the block will present a flat contact surface complementary to the roof angle irrespective of the sense in which the boot is applied to the leg, irrespective of which leg it is applied to, and irrespective of which side of the roof ridge the ladder is positioned on.

According to a further feature of the invention, the block is formed as a monolith and preferably, as a block of homogeneous molded plastic material. This arrangement allows the compensator boot to be produced inexpensively, with great precision, utilizing high volume production techniques.

In the disclosed embodiment of the invention, the block has a generally rectangular transverse cross-sectional configuration; the socket has a generally rectangular transverse cross-sectional configuration having major and minor dimensions respectively paralleling the major and minor dimensions of the block; and the central apex edge on the lower end face of the block extends in the direction of the major cross-sectional dimensions of the block so as to provide large area contact surfaces, skewed in opposite senses, on opposite sides of the central apex edge to allow the convenient and efficient utilization of the ladder on either side of the ridge of an angled gable roof.

DETAILED DESCRIPTION OF THE PREFERRED EMBODIMENT

Figure 1:
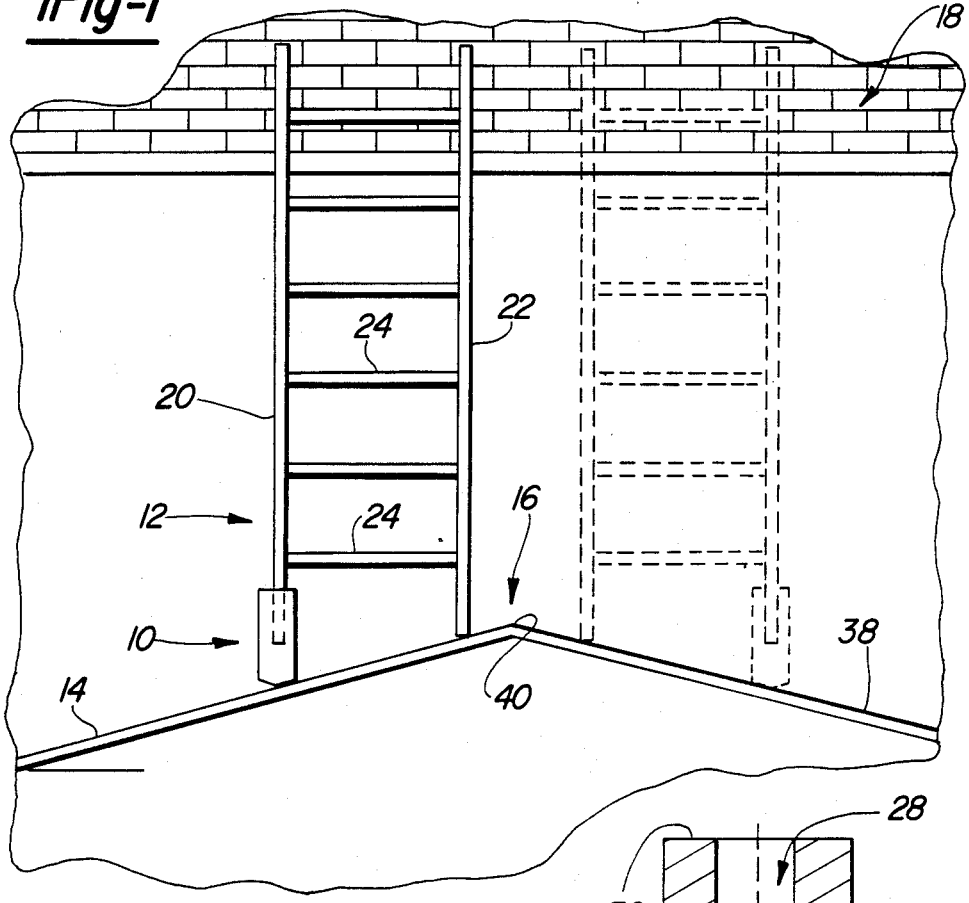
FIG. 1 is a fragmentary view showing the use of the invention compensator boot on a gable roof.
Figure 2:
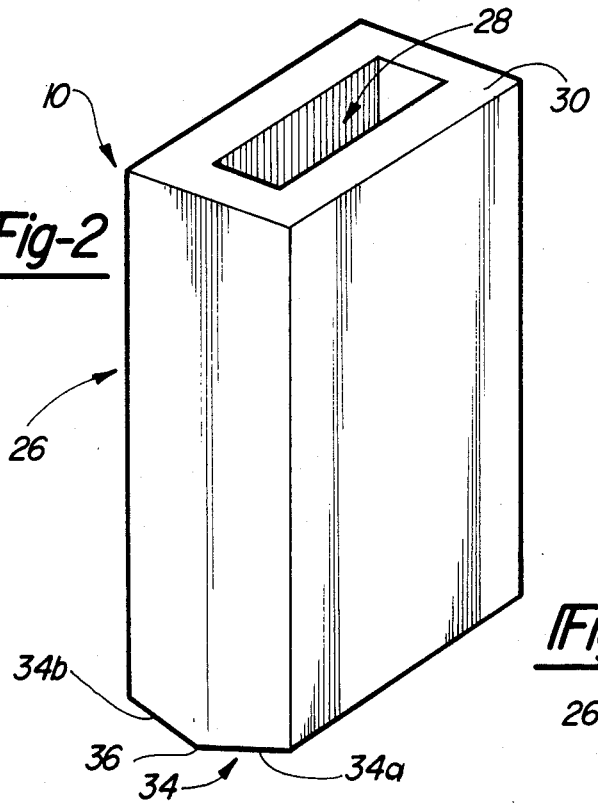
FIG. 2 is a perspective view of the invention compensator boot.
Figure 3:
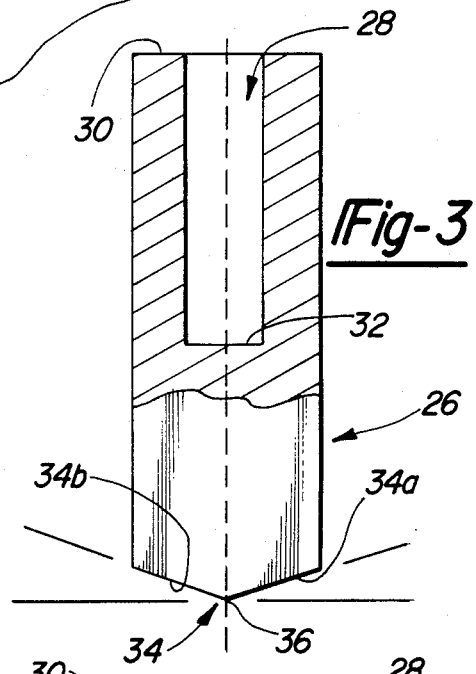
FIG. 3 is a fragmentary end elevational view of th invention compensator boot.
Figure 4:
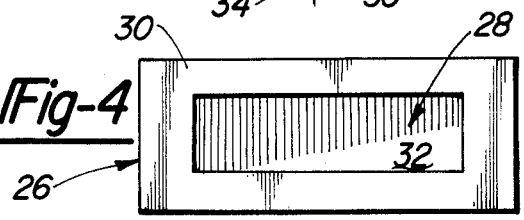
FIG. 4 is a top view of the invention compensator boot.

The invention compensator boot 10 is seen in FIG. 1 in cooperation with a ladder 12 which is shown positioned on the sloping or angled roof surface 14 of a gable roof 16 with the upper portion of the ladder shown resting against the lower edge of an upper roof 18.

The ladder 12 includes side rails or legs 20 and 22 and a plurality of vertically spaced rungs 24 extending between the legs.

Compensator boot 10 is preferably formed as a monolith and is further preferably formed in a molding operation employing a plastic or rubber material.

Boot 10 comprises a vertically elongated block 26 of homogeneous material having a generally rectangular cross section and a vertically extending socket 28 opening in the upper end face 30 of the block and having a blind lower end 32 spaced vertically from the lower end face 34 of the block by a distance compensating for the roof angle.

Socket 28 has a generally rectangular transverse cross section sized to allow the lower end of a leg 20,22 of the ladder to slide readily but snuggly into the socket and having major and minor dimensions respectively parallelling the major and minor dimensions of the block.

The lower end face 34 of the block is centrally downwardly pointed to define a central apex edge 36 extending in the direction of the major cross-sectional dimension of the block with the end face portions on opposite sides of edge 36 skewed in opposite senses to provide angled contact surfaces **34*a* and 34*b*** of opposite sense.

In a typical application, block 12 may have a vertical height of 12 inches and cross-sectional dimensions of $5\frac{1}{2}$ and 2½ inches; slot 28 may have a depth of 6 inches and cross-sectional dimensions of 3¾ and 1 inches; and the skewer angle alpha of the contact surfaces 34*a* and 34*b* may be 15 degrees to match the angle of roof surface 14.

In the use of the invention compensator boot in conjunction with angled roof surface 14 of gable roof 16, compensator boot 10 is slipped onto the lower end of the leg 20 of ladder 12 so that, when the ladder 12 is positioned on angled roof 14, angled contact surface 34*a* is positioned in complementary fashion on angled roof 14 and the other leg 22 of the ladder contacts the roof surface directly. The ladder is thus disposed in a precise vertical orientation despite the angled aspect of the roof.

If it is desired to utilize the ladder on the oppositely angled roof surface 38 on the other side of roof ridge 40, the ladder may either be rotated through 180 degrees or the boot 10 may be slipped off of leg 20 and slipped onto the leg 22. In either event, an angled contact surface 34*a* or 34*b* will firmly and complementarily engage the roof surface 38. Specifically, if the ladder is simply rotated through 180 degrees, contact surface 34*a* will continue to provide the roof engaging surface, and if the boot is slipped off of leg 20 and onto leg 22 without rotation of the ladder, contact surface 34*b* will now provide the firm complementary contact surface engaging the angled roof 38.

It will be seen that, for a given gabled roof having a given roof angle, the invention compensator boot functions to present a flat, properly compensated contact surface to the angled roof surface irrespective of the sense in which the boot is applied to the leg of the ladder, irrespective of which leg of the ladder it is applied to, and irrespective of which side of the roof ridge the ladder is positioned on. The invention compensator boot thus provides an inexpensive and virtually foolproof ladder leveling device which greatly facilitates the use of the ladder on gabled roofs or other angled surfaces.

Whereas a preferred embodiment of the invention has been illustrated and described in detail, it will be apparent that various changes may be made in the disclosed embodiment without departing from scope or spirit of the invention.

I claim:

1. A compensator boot to facilitate the use of a ladder on an angled surface such as a roof, said boot comprising:

(A) a vertically elongated block of material having a generally rectangular transverse cross section having major side face dimensions and minor end face dimensions;

(B) a vertically extending socket in said block opening in the upper end face of the block, having a generally rectangular transverse cross section with major and minor dimensions respectively paralleling the major and minor dimensions of said block, being sized to allow the lower end of a leg of the ladder to slide into the socket, and having a blind lower end spaced vertically from the lower end face of said block by a distance compensating for the roof angle; and (C) means defining a flat contact surface on said lower end face that extends from end face to end face of said block and is skewed with respect to the vertical axis of the block to match the roof angle.

2. A boot according to claim 1 wherein:

(D) said lower end face of said block is centrally downwardly pointed to form a central apex edge extending from end face to end face of said block and the end face portions on the opposite sides of said central apex edge are each skewed, but in opposite senses, to match the roof angle so that the block will present a flat contact surface complementary to the roof angle irrespective of the sense in which the boot is applied to the leg, irrespective of which leg it is applied to, and irrespective of which side of the roof ridge the ladder is positioned on.

3. A boot according to claim 2 wherein said block is formed as a monolith.

4. A boot according to claim 3 wherein said block is formed as a molded plastic article.

5. A compensator boot to facilitate use of a ladder on an angled surface such as a roof, said boot comprising:

(A) a vertically elongated block of monolithic material having a generally rectangular transverse cross section having major and minor dimensions;

(B) a vertically extending socket in said block opening in the upper end face of said block and having a blind lower end spaced vertically from the lower end face of said block by a distance compensating for the roof angle;

(C) said socket having a generally rectangular transverse cross section sized to allow the lower end of a leg of a ladder to slide into the socket and having major and minor dimensions respectively paralleling the major and minor dimensions of said block; and (D) said lower end face of said block being downwardly centrally pointed to define a central apex edge extending in the direction of the major cross-sectional dimension of the block with the end face portions on opposite sides of said apex edge skewed in opposite senses to match the roof angle so that the block presents a lower end face portion complementary to the roof angle irrespective of the sense in which the boot is applied to the leg of the ladder, irrespective of which leg it is applied to, and irrespective of which side of the roof ridge the ladder is positioned on.

6. A boot according to claim 5 wherein said block is formed as a monolith.

7. A boot according to claim 6 wherein said block is formed as a molded plastic article.

8. A ladder assembly comprising:

(A) a ladder having vertical legs and vertically spaced rungs extending between said legs; and (B) a boot sized to fit over the lower end of one of said legs;

(C) said boot comprising a vertically elongated block of material having a generally rectangular transverse cross section having major side face dimensions and minior end face dimensions;

(D) said block defining a vertically extending socket opening in the upper end face of the block, having a generally rectangular cross section with major and minor dimensions respectively paralleling the major and minor dimensions of said block, and being sized to allow the lower end of one of said legs to slide into the socket; and (E) said block further including means defining a flat contact surface on said lower end face thereof that extends from end face to end face of said block and is skewed with respect to the vertical axis of said block to match the roof angle.

* * * * *